US005149020A

United States Patent [19]

Rundle et al.

[11] Patent Number: 5,149,020

[45] Date of Patent: Sep. 22, 1992

[54] TETHERED ROTARY KITE

[76] Inventors: Craig V. Rundle, 21815 SE. 265th St., Maple Valley, Wash. 98038; Gary L. Hooten, P.O. Box 410, Port Townsend, Wash. 98368

[21] Appl. No.: 765,872

[22] Filed: Sep. 26, 1991

[51] Int. Cl.[5] ..... B64C 31/06

[52] U.S. Cl. ..... 244/153 A

[58] Field of Search ..... 244/153 R, 153 A, 154, 244/155 R, 155 A, 8; 446/30–45

[56] References Cited

U.S. PATENT DOCUMENTS

| | | | |
|---|---|---|---|
| 1,491,997 | 4/1924 | Messick | 416/131 |
| 2,138,168 | 11/1938 | Horak | 446/44 |
| 2,442,846 | 6/1948 | Dunn | 244/153 A |
| 2,524,500 | 10/1950 | Whitehurst | 244/153 R |
| 3,194,521 | 7/1965 | Rider et al. | 244/154 |
| 4,154,017 | 5/1979 | Bilardi et al. | 446/36 |

FOREIGN PATENT DOCUMENTS

| | | | |
|---|---|---|---|
| 508119 | 1/1952 | Belgium | 244/153 A |
| 825089 | 2/1938 | France | 244/154 |
| 930727 | 2/1948 | France | 446/36 |

*Primary Examiner*—Galen Barefoot

[57] ABSTRACT

A wind-powered flying device, generally known as a roto-kite, is described which allows for flight even in slight wind conditions yet also functions well in strong wind conditions. The roto-kite has a stabilizing keel with adjustable position on a main body shaft and rotating wings hinged to the shaft to allow for flapping to relieve stresses from unbalanced forces during rotation. A tether is attached to a tiller arm on the keel such that when the tether causes the tiller to turn in the wind the roto-kite changes direction.

15 Claims, 2 Drawing Sheets

TETHERED ROTARY KITE

BACKGROUND OF THE INVENTION

This invention relates to aerial toys or novel flying devices, and more specifically to tethered kites with rotary air foils.

It is known in the art to have tethered airborne toys such as kites and devices with rotary air foils. For example, Brumfield, U.S. Pat. No. 2,793,829, describes a rotary kite with a plurality of air foil blades capable of maintaining it airborne with a stabilizing counterbalance functioning in the manner of a traditional kite tail. Similarly, Bilardi, U.S. Pat. No. 4,154,017 describes a tethered body with a single wing rotating on the body; a body rudder controlled by the tethers provides maneuverability and stability. These and other previous disclosures do not provide for flapping on the wing mount the fuselage or a stabilizing air foil keel on the main body.

It is known in helicopter flight that forces on the rotating air foils, or blades, change during a blade revolution due to differences in lift forces as the blade presents a different relative air speed and foil shape to prevailing air movement (wind). If the blade is mounted on a horizontal hinge, set usually at 90 degrees to the span of the blade, it is allowed to oscillate vertically, or flap. The degree of flapping is the result of the cyclical change of balance between centrifugal, inertial, and lift forces. Flapping capability in the hinge mount is provided to provide fuselage stability and relieve stress on the blade mount as opposing blades in different phases of rotation provide unbalanced lift forces.

It is well-known in kite flying that a bias is required in the kite body or the kite becomes unstable. This bias is generally provided in the form of a tail secured to the kite bottom, causing the kite to remain in a preferred orientation. An rudder extended from the kite body or a fuselage has also been found useful in providing this orientation stability, similar to the function of a helicopter tail rotor or a weather vane. As a keel of a boat in water, a keel is provided in this invention on the main body (fuselage), functioning as an improved stabilizer and eliminating the need for a long tail. As in the manner of all keels in fluids, by design the keel opposes movement away from the direction of prevailing wind, yet provides for a quick manuevering response. The position of the keel on the main body helps determine the degree of stability, with a lower position providing increased stability. Adjustment of the keel position allows the operator to adapt the flying device to different flying conditions.

It is therefore an object of the invention to provide an aerial flying device with one or more rotary air foils providing lift to the device in combination with a stabilizing keel on the main body.

It is also an object of the invention to provide tiller means for attaching a tether to the flying device for flight control.

It is a further object to provide an air foil of opposing rotating wings or blades.

It is another object that the opposing blades be mounted on horizontal hinges that allow flapping of the blades.

It is yet another object to provide a means to adjust the position of the keel on the main body of the flying device.

Still another object is to provide for automatic adjustment of the keel position for variable flying conditions.

A final object is to provide a device that can fly in very slight winds.

SUMMARY OF THE INVENTION

According to the invention, the above objects are achieved in a wind-powered flying device with a keel and rotating blades, generally referred to as a roto-kite, which allows for flight even in slight wind conditions yet also functions well in strong wind conditions. The roto-kite comprises at least one pair of opposing air foil blades spaced apart and attached to a common hinge mount on a main roto-kite body in the general manner of helicopter blades to allow for flapping of the blades as lift forces change during revolution of the blades. The keel is on the main body to provide stability in the prevailing wind, weak or strong. Adjustment of the keel is provided, either manual or automatic, to increase stability by moving the keel away from the blade mount. A tether is attached to a tiller arm on the keel such that when the tether causes the tiller to turn in the wind the roto-kite changes direction.

DESCRIPTION OF THE PREFERRED EMBODIMENT

Figure 1:
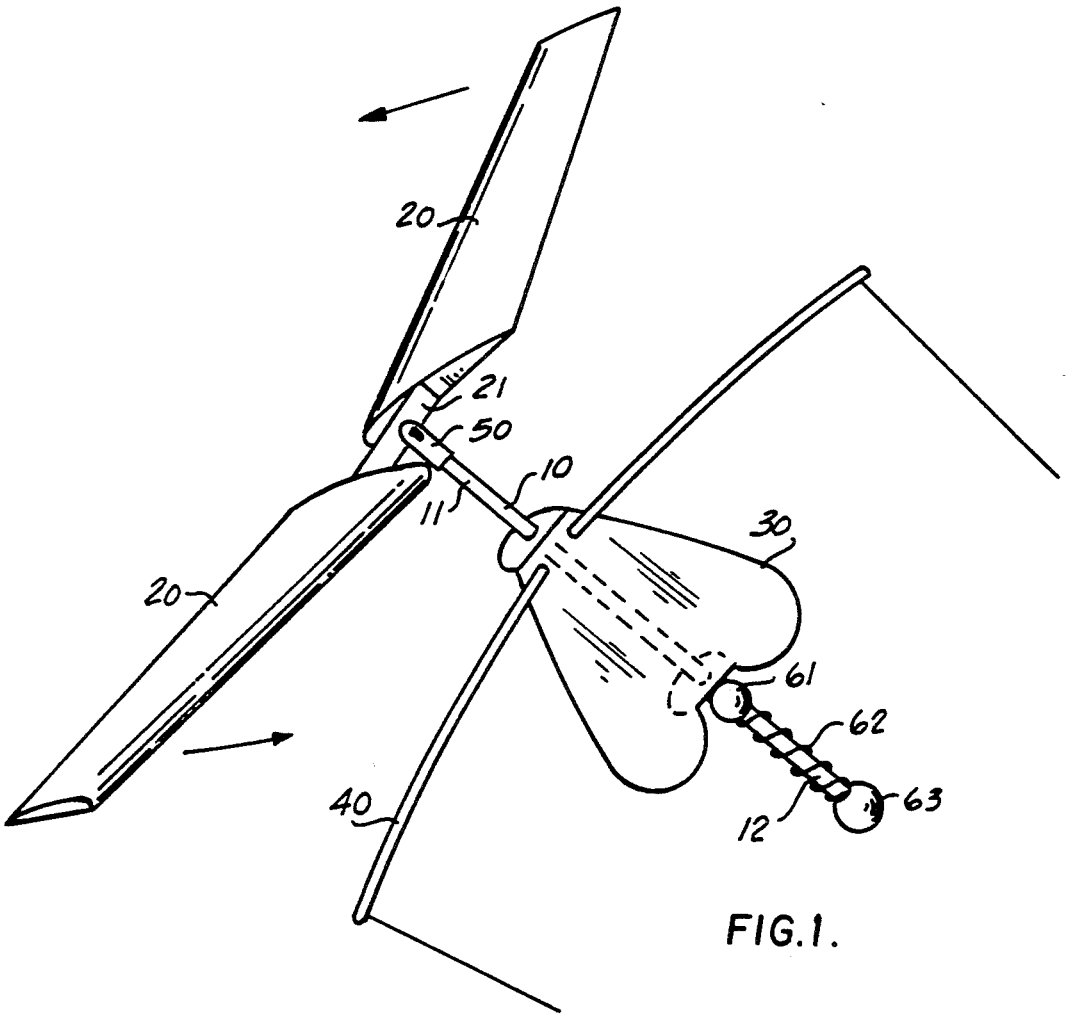
FIG. 1 is a perspective view showing a roto-kite, a wind-powered toy with lift provided by two rotating air-foil blades, and also having a stabilizing main body keel.
Figure 2:
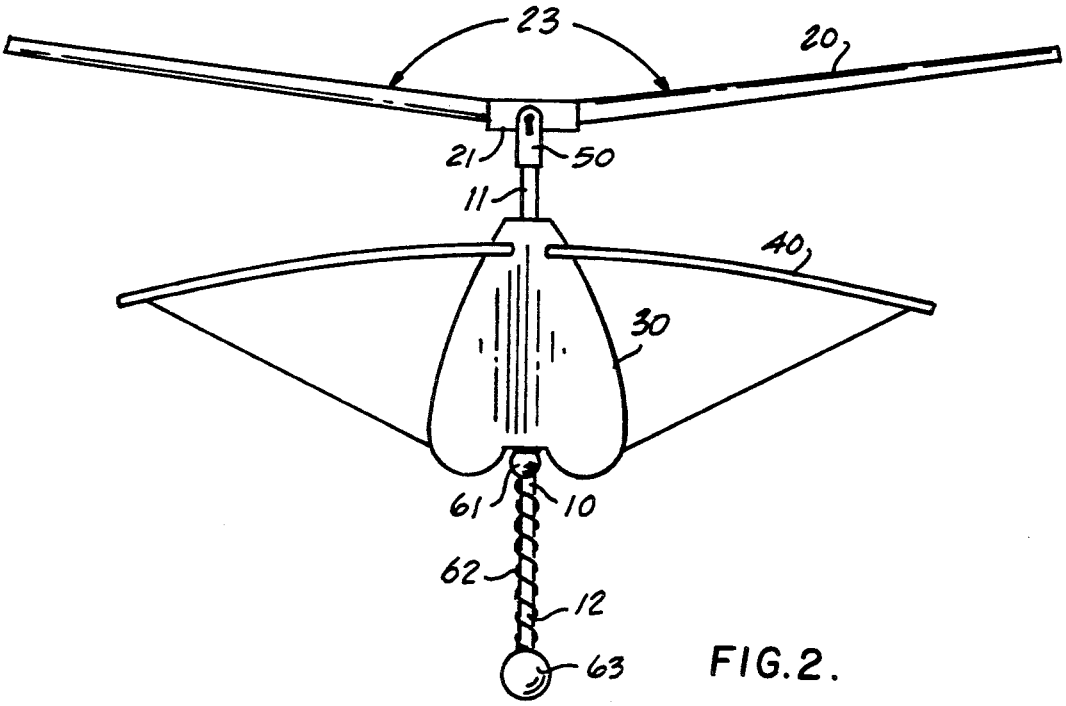
FIG. 2 is a front view of the roto-kite showing the tether attachment tiller arm on the body keel, two inclined and opposing, rotating blades, and bias spring for automatic position adjustment of the keel on the body.

Referring to the figures, FIG. 1 shows a roto-kite as it would appear in operation, comprising principally a body shaft 10, opposing air foil blades 20 in autorotation, and a body keel 30 with a tiller arm 40. FIG. 2 shows the center shaft 10 with a hinge blade mount 50 secured on a shaft upper end 11 and a bias spring 60 on a shaft lower end 12. Hinge blade mount 50 further has a channel groove 51 in its free end and holes 52.

Although the shape of the air foils 20 may take a variety of forms, the air foils 20 typically comprise opposing wings having the general shape of a fixed-wing aircraft wing with a leading edge and a trailing edge. However, unlike a fixed wing aircraft, only one wing presents its leading edge to the on-coming wind, the other wing presents its trailing edge. Thus, in rotation each wing presents its leading edge as it advances toward a prevailing wind during wing rotation and presents its trailing edge to the wind upon retreat from the wind during rotation. The traditional wing is shaped has a predominantly uniformly-flat undersurface and a negative curvature uppersurface with a radius of curvature in the leading edge greater than that of the trailing edge to provide a resultant lift force when passing through wind. The air foils also experiences autorotation when wind produces an upward flow of air from under the air foils.

The roto-kite air foil blades 20 are mounted to and spaced apart by a blade plate 21 having a mounting hole 22 passing through its center of gravity (with blades mounted). The blades 20 are shown elevated with respect to each other in the rest position such that an obtuse dihedral angle 23 is formed by extrapolated planes of the wings, to promote roll stability in the device. Typically, the blades 20 are made of styrofoam for efficiency of cost although they can also be made light wood (balsa) or wood ribs covered with paper or plastic in the accustomed manner of model planes. Larger models, of course, would be built with materials suitable for the strength required.

A horizontal pivot pin 53 passes through aligned plate mounting hole 22 and hinge holes 52 to pivotably mount the blades to the main body center shaft 10. Thus, the body shaft 10 rotates with the blades 20 during operation. It should be noted that a central hinge mount 50 common to both blades 20 is used as opposed to off-set flapping hinges to eliminate tilting of the blades 20 when one blade creates a greater lift than the other blade during different phases of rotation.

Figure 4:
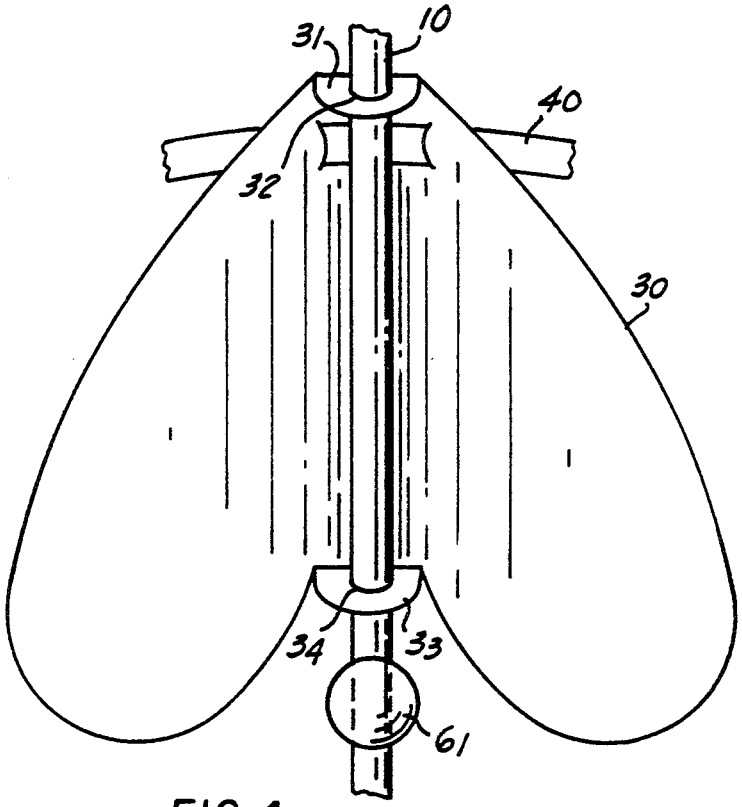
FIG. 4 is a rear view of the body keel on the body shaft.
Figure 5:
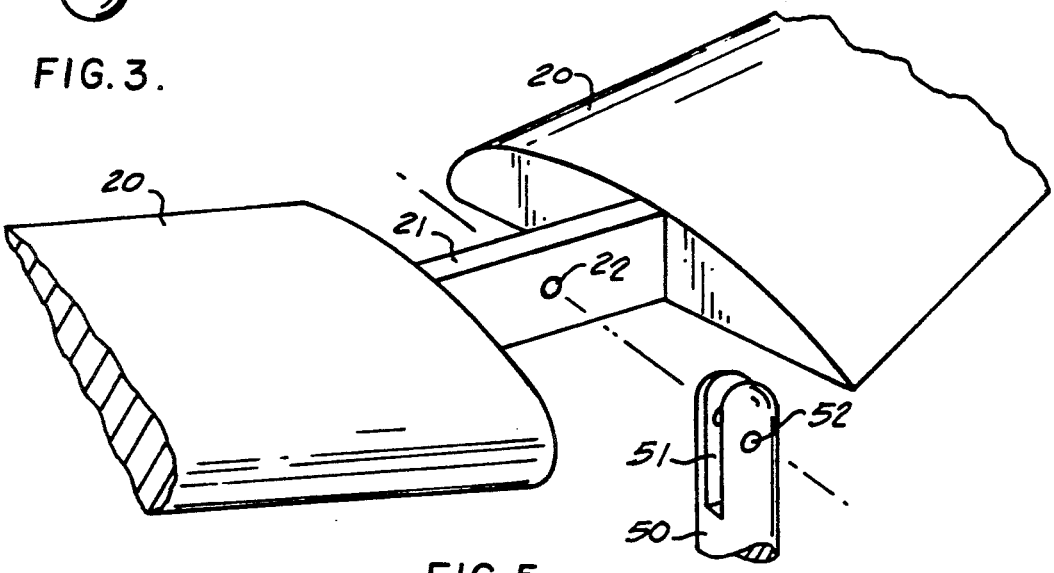
FIG. 5 is a perspective view of the hinge blade mount of the air foil blades to the body shaft.

The body keel 30, shown in FIG. 4 as it is cut from sheet when made of plastic, is symmetrical, narrow at its top and curvilinearly flaring toward its bottom. Curvilinear sheet sides wrap toward each other around a keel vertical axis to form an open 3-dimensional curvilinear surface. At its top is a top mounting plate 31 with a top shaft hole 32; similarly, at its bottom is a bottom mounting plate 33 with a bottom shaft hole 34. The mounting plates 31 and 33 are bent at right angles towards the concave curvilinear keel surface. The body shaft 10 then passes through top and bottom shaft holes 32 and 34. As the blades 20 rotate in the wind, the body shaft 10 rotate sin the keel mounting holes 32 and 34. For large roto-kites, a bearing between the keel 30 and the body shaft 10 may be provided, but for a typical toy application, the body shaft 10 spins sufficiently in the shaft holes 32 and 34 in the keel 30 without the added complexity and expense of bearings or the like.

A tiller arm 40 bowed away from the air foil blades, typically made of plastic rod, is secured to the body keel 30 to enable an operator to control the roto-kite. It may also be secured with a guy string from the tiller ends to the bottom of the keel 30. Tiller arm holes 35 are provided in the keel 30 through which the arm 40 horizontally passes. Tethers 70 attached to the tiller arm 40 are used to turn the keel 30. As the turned keel shows a different presentation to the wind, the roto-kite tends to change direction in yaw and roll as the keel reacts to unbalanced forces from the wind. The body shaft tilts along with the rotating blades, and the lift vector changes, furthering the change in direction. Using the tethers to reverse the keel orientation corrects the roll and returns the roto-kite to normal flight.

Figure 3:
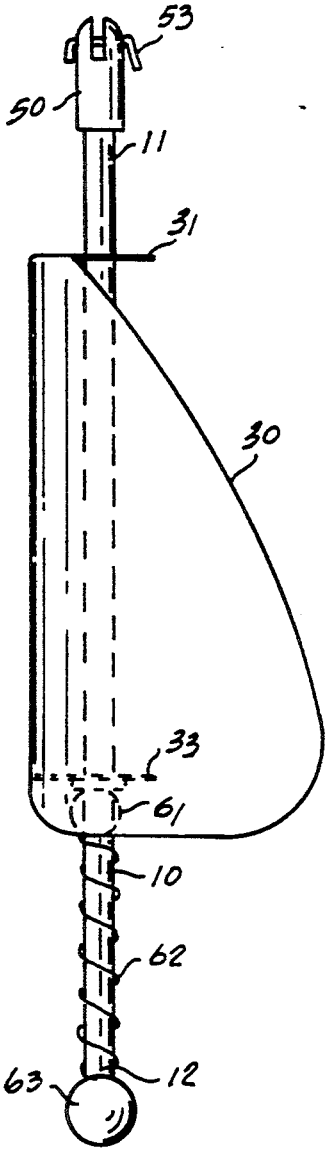
FIG. 3 is a side view of the roto-kite showing the common hinge for blade attachment, the body keel, and the spring adjustment for keel adjustment.

The body keel 30 is located and supported by a keel support 61 on the body shaft 10 which supports the keel at its bottom mounting plate 33. When the position of the keel support 61 is determined manually, the support is mounted with a frictional fit on the body shaft 10. When the support position is determined automatically, the keel support 61 is loosely mounted slidably over the body shaft 10. Adjustment is then determined by wind conditions. As shown in FIG. 2 and FIG. 3, a bias spring 62 may be installed between the keel support 61 and a stop 63 on the shaft 10, typically secured near the shaft lower end 12. When wind increases, causing greater lift on the blades 20, pull on the tethers increases causing the keel 30 to move toward the shaft lower end 12, compressing the bias spring 62 and providing increase stability with the keel in a lower position. When wind decreases, the bias spring 62 returns the keel closer to the blades 20, in this way optimizing the roto-kite for varying flight conditions.

Having described the invention, what is claimed is:

1. A tethered flying device, generally referred to as a roto-kite, comprising a body shaft with an upper end and a lower end, a rotating air foil means having aerodynamically lifting surfaces, means to attach the air foil to the upper end of the body shaft, a stabilizing keel having a top and a bottom, slidably and rotatably mounted on the body shaft intermediate the shaft length, further comprising means to adjustably secure the keel at a selective position on the body shaft.

2. A tethered flying device, generally referred to as a roto-kite, comprising a body shaft with an upper end and a lower end, a rotating air foil means having aerodynamically lifting surfaces, means to attach the air foil to the upper end of the body shaft, a stabilizing keel having a top and a bottom, rotatably mounted on the body shaft intermediate the shaft length, and comprising a symmetrical open 3-dimensional curvilinearly surface narrow at its top and flaring toward its bottom and curved around the body shaft when mounted with the keel radius of curvature increasing from the keel bottom toward the keel top.

3. The invention of claim 1 or claim 2 further comprising a tiller arm extending outwardly from the keel for attachment of tethers on each end for control of the roto-kite.

4. The invention of claim 1 wherein the keel is slidably mounted on the body shaft.

5. The invention of claim 4 further comprising means to adjustably secure the keel at a selective position on the body shaft.

6. The invention of claim 1 further comprising means to automatically position the keel at a selective position on the body shaft.

7. The invention of claim 6 wherein the means to automatically position the keel at a selective position on the body shaft comprises a stop on the body shaft lower end, a spring over the body shaft between the stop and the keel for biasing the keel away from the stop.

8. The invention of claim 1 or claim 2 wherein the means to attach the air foil to the upper end of the body shaft further comprises hinge means to pivotably mount the air foil means to the body shaft so that the air foil means can flap on the body shaft.

9. The invention of claim 8 wherein the hinge means to pivotably mount the air foil means to the body shaft comprising a channel groove with securing holes, an plate centered in the rotating air foil matching the channel groove and slidably fitted therein and with a hole in the plate aligned with the channel groove securing holes, a pin through the securing holes and the channel groove pivotably securing the air foil plate in the channel groove such that the air foil and the body shaft thus mounted rotate together.

10. The invention of claim 1 or claim 2 wherein the air foil comprises two opposing air foil wings as in conventional aircraft, each wing having the general aerodynamic shape with resulting lift forces of a fixed-wing aircraft wing with a leading edge and a trailing edge, configured on the body shaft such that the wing presents its leading edge as it advances toward a prevailing wind during wing rotation and presents its trailing edge to the wind upon retreat from the wind during rotation.

11. The invention of claim 10 wherein the two opposing air foil wings are configured such that the extrapolated planes of the wings form an obtuse dihedral angle.

12. The invention of claim 10 wherein the two opposing wings are wide to enable flight in relatively low prevailing wind speeds.

13. The invention of claim 1 wherein the keel comprises a symmetrical open 3-dimensional curvilinearly surface narrow at its top and flaring toward its bottom and curved around the body shaft when mounted with the keel radius of curvature increasing from the keel bottom toward the keel top, an upper mounting plate with an upper plate hole, a lower mouting plate with a lower plate hole, the the plate approximately orthogonal to the body shaft with the shaft passing through and rotating within the plate holes.

14. The invention of claim 2 wherein the keel is rotatably mounted to the body shaft by means of a top mounting plate on the keel with a top shaft hole, a bottom mounting plate n the keel with a bottom shaft hole, the plate approximately orthogonal to the body shaft with the shaft passing through and rotating within the plate holes, and a keel support on the body shaft which supports the keel at its bottom mounting plate.

15. A tethered flying device, generally referred to as a roto-kite, comprising a body shaft with an upper end and a lower end having a channel groove with securing holes in the shaft upper end, a plate matching the channel groove and slidably fitted therein and with a hole in the plate aligned with the channel groove securing holes, two opposing wing air foils spaced apart by the plate and having aerodynamically lifting surfaces having the general shape of a fixed-wing aircraft wing with a leading edge and a trailing edge, configured on the body shaft such that the wing presents its leading edge as it advances toward a prevailing wind during wing rotation and presents its trailing edge to the wind upon retreat from the wind during rotation.

a pin through the securing holes and the channel groove pivotably securing the plate in the channel groove such that the wing air foils and the body shaft thus mounted rotate together, a stabilizing keel comprising a top and a bottom with the keel rotatably mounted slidably on the body shaft intermediate the shaft length with the keel top toward the shaft upper end and the keel bottom toward the shaft lower end, a symmetrical open 3-dimensional curvilinearly surface narrow at its top and flaring toward its bottom and curved around the body shaft when mounted with the keel radius of curvature increasing from the keel bottom toward the keel top, an upper mounting plate with an upper plate hole, a lower mounting plate with a lower plate hole, the plates approximately orthogonal to the body shaft with the shaft passing through and rotating within the plate holes, means to adjustably secure the keel at a selective position on the body shaft, a tiller arm extending outwardly from the keel for attachment of tethers on each end for control of the roto-kite, hinge means to pivotably mount the air foil means to the body shaft so that the air foil means can flap on the body shaft.

* * * * *